US012419447B1

(12) United States Patent
Amick

(10) Patent No.: US 12,419,447 B1
(45) Date of Patent: Sep. 23, 2025

(54) DUAL MATERIAL BED LINEN SET

(71) Applicant: Sabrine Amick, Chapin, SC (US)

(72) Inventor: Sabrine Amick, Chapin, SC (US)

( * ) Notice: Subject to any disclaimer, the term of this patent is extended or adjusted under 35 U.S.C. 154(b) by 310 days.

(21) Appl. No.: 18/138,503

(22) Filed: Apr. 24, 2023

(51) Int. Cl.
*A47G 9/02* (2006.01)

(52) U.S. Cl.
CPC ..... *A47G 9/0253* (2013.01); *A47G 9/0238* (2013.01)

(58) Field of Classification Search
CPC ..... A47G 9/02; A47G 9/0238; A47G 9/023; A47G 9/0246; A61G 7/1026
USPC ..... 5/497, 495, 482
See application file for complete search history.

(56) References Cited

U.S. PATENT DOCUMENTS 1,701,058 A * 2/1929 Andrade, Jr. ..... A47G 9/0238 5/482
3,508,284 A * 4/1970 Marquette ..... A47G 9/023 5/486
3,829,914 A * 8/1974 Treat ..... A61G 7/1026 5/81.1 T
3,868,735 A * 3/1975 Ross ..... A47G 9/0246 5/497
4,495,233 A * 1/1985 Bassetti ..... A47G 9/0246 428/102
4,572,174 A * 2/1986 Eilender ..... A61G 7/057 128/889
D379,893 S * 6/1997 Dilbeck ..... D6/602
D507,919 S * 8/2005 Bishop ..... D6/601
7,200,883 B2 4/2007 Haggerty
9,149,137 B2 10/2015 Liddick
10,363,188 B2 * 7/2019 Young ..... A61G 7/1051
2001/0044963 A1 * 11/2001 Sky ..... A47G 9/0238 5/482
2005/0268399 A1 * 12/2005 Demarco ..... A47G 9/023 5/486
2005/0273930 A1 * 12/2005 Phillipps ..... A47G 9/0223 5/486
2006/0282950 A1 * 12/2006 Shuster ..... A47G 9/0246 5/486
2007/0157383 A1 * 7/2007 Burns ..... A47G 9/0238 5/486
2008/0235870 A1 * 10/2008 Heide ..... A47G 9/068 5/482
2010/0017962 A1 * 1/2010 Bevan ..... A47G 9/0253 5/482

(Continued)

FOREIGN PATENT DOCUMENTS

CA 2286917 A1 * 2/2000 ..... A47G 9/02
CA 2664501 A1 * 9/2010 ..... A47G 9/0238

(Continued)

*Primary Examiner* — Eric J Kurilla
(74) *Attorney, Agent, or Firm* — Sanchelima & Associates, P.A.; Jesus Sanchelima; Christian Sanchelima

(57) ABSTRACT

A dual material bed linen set including a sheet assembly and a pillowcase assembly. The sheet assembly includes at least one sheet having a left portion, a right portion, a top band and a bottom band. The left portion and the left portion are made of different materials so that each of the portions provide a certain thermal sensation. The pillowcase assembly includes a pillowcase, the pillowcase has a top portion and a bottom portion. The top portion and the bottom portion are made of different materials such as cotton and flannel which provide a certain differentiated thermal sensation therebetween.

8 Claims, 3 Drawing Sheets

(56) References Cited

U.S. PATENT DOCUMENTS

| | | | | |
|---|---|---|---|---|
| 2012/0246828 | A1* | 10/2012 | Argento | A47G 9/02 5/486 |
| 2015/0196146 | A1* | 7/2015 | Liddick | A47G 9/02 5/486 |
| 2020/0187682 | A1* | 6/2020 | Pappas | A47G 9/0261 |
| 2021/0267391 | A1* | 9/2021 | Nagy | A47G 9/023 |
| 2021/0289960 | A1* | 9/2021 | Ullrich | A47G 9/0223 |
| 2022/0031098 | A1* | 2/2022 | Nagy | A47G 9/023 |
| 2024/0108156 | A1* | 4/2024 | Czerwinski | A47G 9/0253 |

FOREIGN PATENT DOCUMENTS

| | | | | |
|---|---|---|---|---|
| ES | 2394874 | A2 * | 2/2013 | A47G 9/02 |
| WO | WO-2012145834 | A1 * | 11/2012 | A47G 9/0238 |

* cited by examiner

DUAL MATERIAL BED LINEN SET

BACKGROUND OF THE INVENTION

1. Field of the Invention

The present invention relates to a dual material bed linen set and, more particularly, to a dual material bed linen set that is used to have the benefits of two types of sheets and being able to identify that they are interchangeable.

2. Description of the Related Art

Several designs for linen sets have been designed in the past. None of them, however, include sheets having a left side and a left side having a wider band on both top and bottom to make both sides interchangeable.

Applicant believes that a related reference corresponds to U.S. Pat. No. 9,149,137 issued for a dual-paneled bedding system that includes a sheet where one panel is composed of a first material, and the second panel is composed of a second material. Applicant believes that another related reference corresponds to U.S. Pat. No. 7,200,883 issued for a bedding system that includes a fitted sheet and a flat sheet where each sheet is divided down the middle and formed from two different materials. None of these references, however, teach of a dual material bed linen set that is comprised of a set of sheets and pillowcases where each sheet and pillowcase is formed from two panels of differing material such as cotton on one side and flannel on the other allowing individuals to change their preference, and whereby the fitted and the top sheet will have a wider band on both top and bottom to make both sides interchangeable.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a dual material bed linen set that includes a left side and a right side made of different materials.

It is another object of this invention to provide a dual material bed linen set including sheets having a top band and a bottom band to make both sides of the sheet bed interchangeable.

It is still another object of the present invention to provide a dual material bed linen set that includes a pillowcase having a top side and a bottom side made of different materials.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
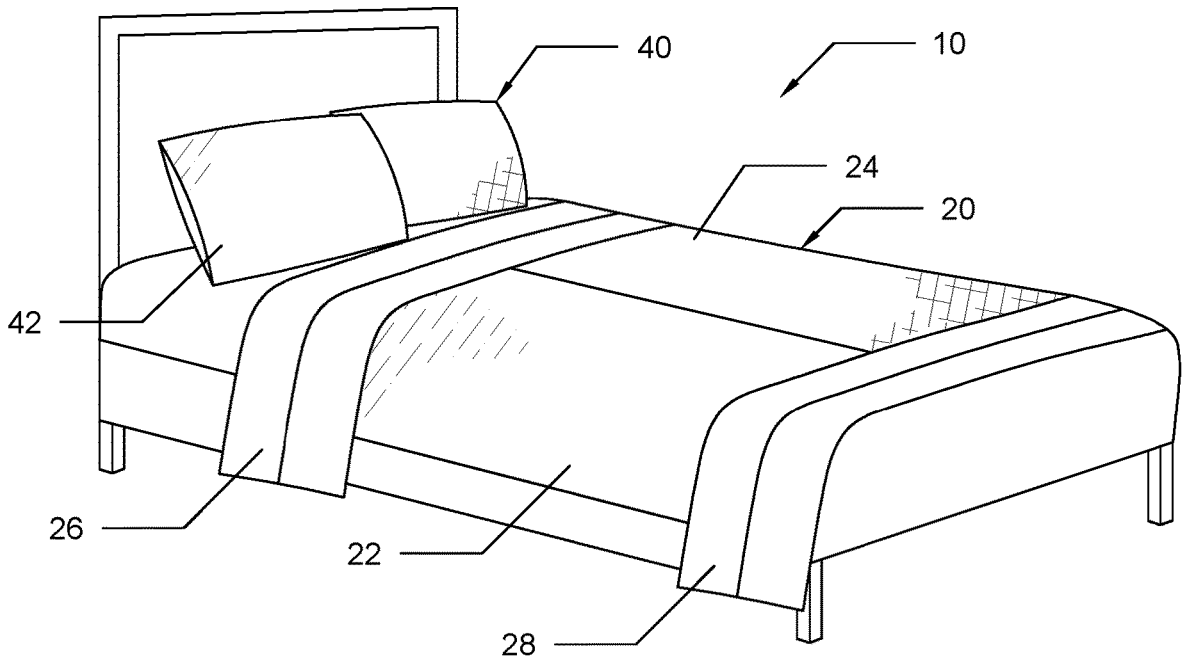
FIG. 1 represents an isometric operational view of the present invention 10.
Figure 2:
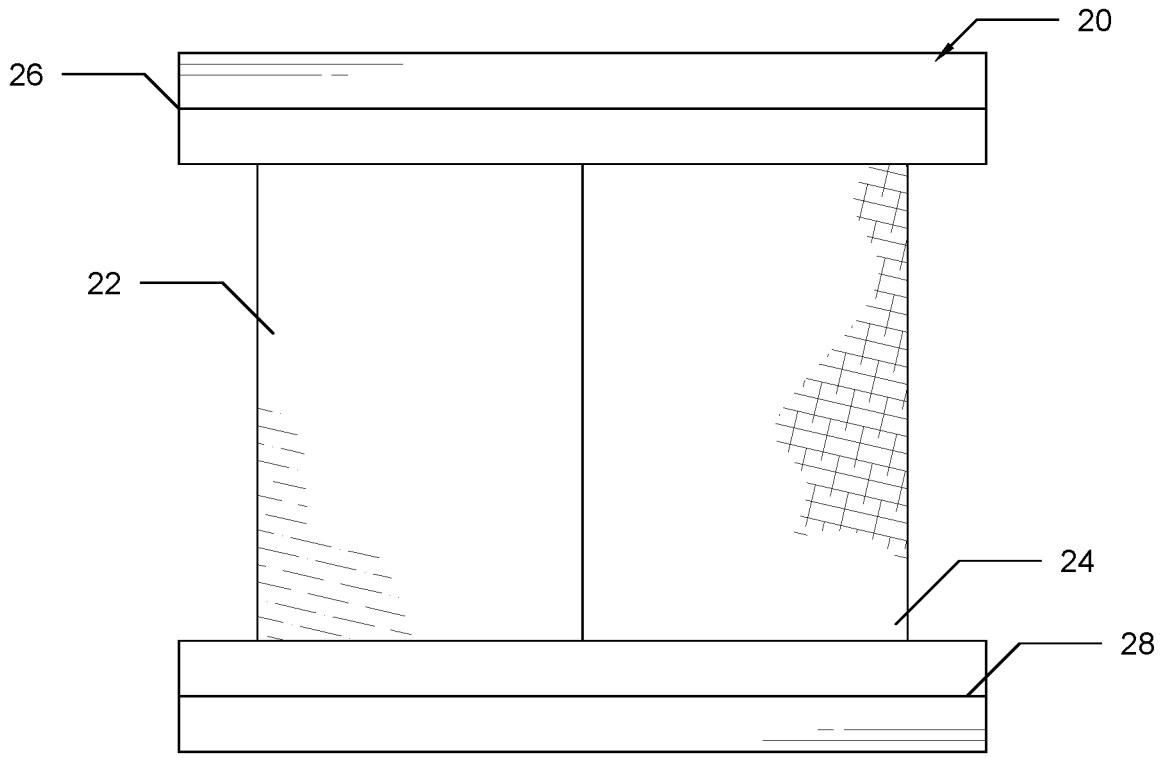
FIG. 2 shows a top view of the sheet assembly 20.

Referring now to the drawings, where the present invention is generally referred to with numeral 10, it can be observed that it basically includes a sheet assembly 20 and a pillowcase assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 3:
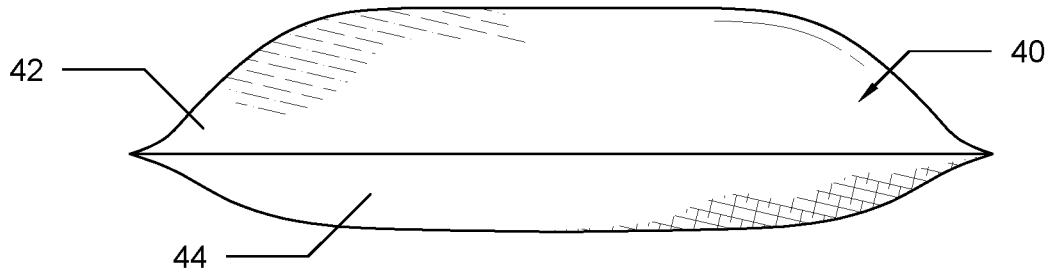
FIG. 3 illustrates a side view of the pillowcase assembly 40.

As best illustrated in FIG. 3 the pillowcase assembly 40 may include a top side 42 and a bottom side 44. In a preferred embodiment the top side 42 and the bottom side 44 may have a rectangular shape. It also may be suitable for the top side 42 and the bottom side 44 to have a circular shape, a triangular shape, or any other suitable shape. In a preferred embodiment the top side 42 and the bottom side 44 may be rectangular fabric-made members sewn together by edges thereof. In one embodiment the pillowcase assembly 40 may define a curved shape. It may be suitable for the pillowcase to have a predetermined strength so that the pillowcase assembly 40 is held open. In a second embodiment the pillowcase assembly may be hollow and retract to an initial position. The pillowcase assembly 40 may have an opening to receive a pillow therein. It also may be suitable for the pillowcase assembly 40 to be built in the pillow.

The bottom side 44 and the top side 42 may be made of different materials. In a preferred embodiment the top side 42 may be made of flannel and the bottom side 44 of cotton. It also may be suitable for the bottom side 44 and the top side 42 to be made of chiffon, linen, or any other suitable material. In a preferred embodiment the bottom side 44 may be made of a material presenting thermal characteristics such as a high thermal conductivity, thermal convection and cooling through evaporation compared with the top side 42. Thus, the top side 42 may present characteristics which produce a warm sensation and the bottom side 44 may present characteristics which produce a cool sensation.

Referring now to FIG. 1 it can be observed that the sheet assembly 20 may include a left side 22, a right side 24, a top band 26 and a bottom band 28. In a preferred embodiment the sheet assembly 20 may have a rectangular shape. It also may be suitable for the sheet assembly 20 to have a circular shape, a triangular shape, or any other suitable shape. It should be understood that the sheet assembly 20 may be a sheet adapted to cover a bed.

The right side 24 and the left side 22 may be made of different materials. In a preferred embodiment the left side 22 may be made of flannel and the right side 44 may be made of cotton. It also may be suitable for the left side 22 and the right side 24 to be made of chiffon, linen, or any other suitable material. In a preferred embodiment the right side 24 may be made of a material presenting thermal characteristics such as a high thermal conductivity, thermal convection and cooling through evaporation compared with the left side 22. Thus, the left side 22 may present characteristics which produce a warm sensation and the right side 24 may present characteristics which produce a cool sensation. The left side 22 and the right side 24 may be interchanged by rotating the sheet assembly 20.

The top band 26 and the bottom band 28 may be made of flannel, cotton, or any other suitable material. The top band 26 and the bottom band 28 may have a rectangular shape. It also may be suitable for the top band 26 and the bottom band 28 to have a triangular shape, a semicircular shape, or any other suitable shape. The top band 26 may be located on a top portion of the sheet assembly 20. The bottom band 28 may be located on a bottom portion of the sheet assembly 20. The top band 26 and the bottom band 28 may be wider than the portion of the left side 22 and the right side 24 sewn together to make the left side 22 and the right side 24 interchangeable therebetween.

Figure 4:
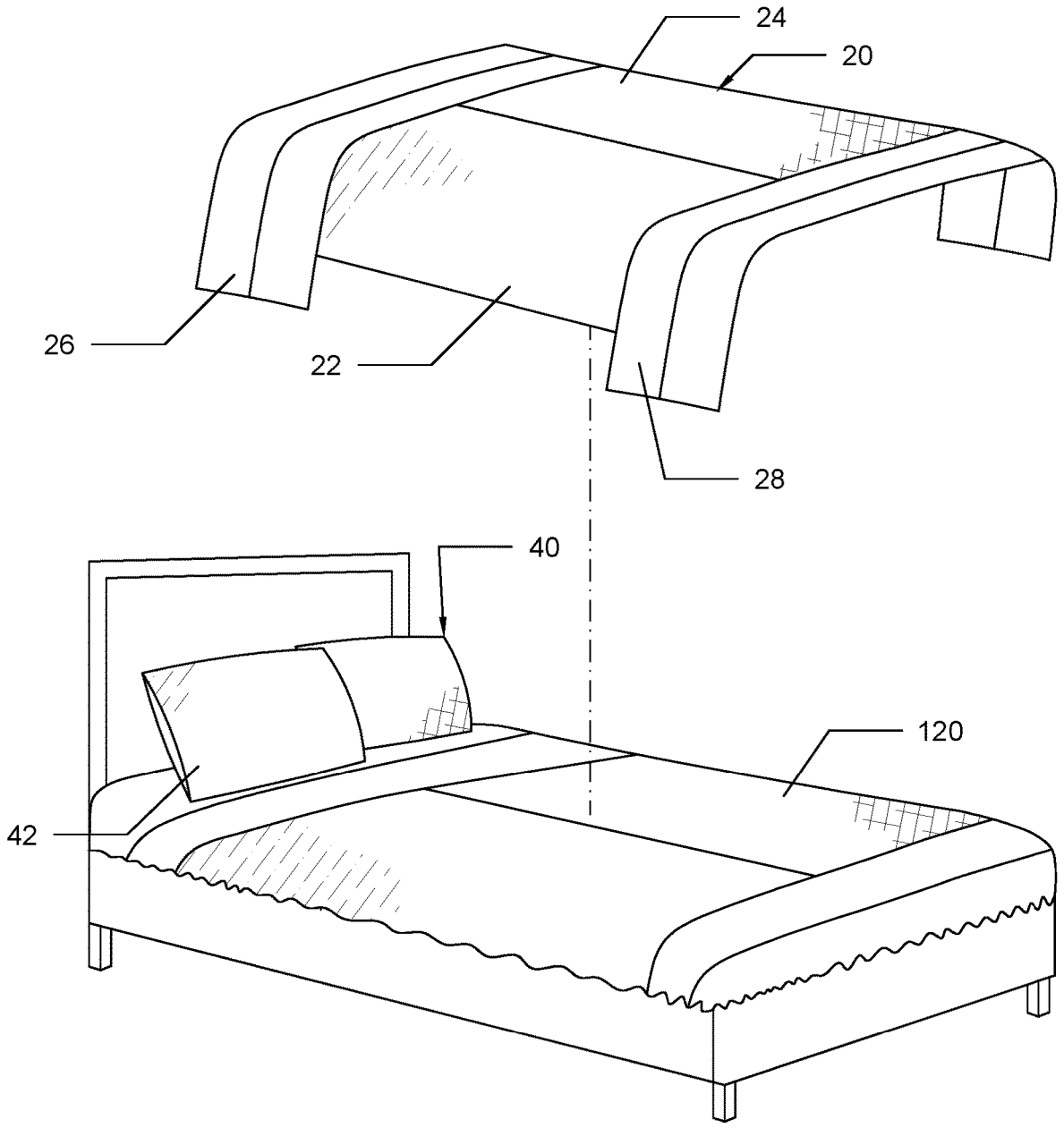
FIG. 4 is an exploded view of the sheet assembly 20.

Referring now to FIG. 4 It should be understood that the sheet assembly 20 may include additional sheets 120, such as a fitted sheet or a top sheet. The additional sheets 120 may further include at least two sides made of different materials. The additional sheets 120 may further include top and bottom bands which are visible when having the sheet assembly 120 thereover.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A dual material bed linen set, comprising:

a sheet assembly, wherein said sheet assembly includes a sheet for bed having a left portion and a right portion, wherein said left portion is made of a first material and said right portion is made of a second material, said sheet including a top band and a bottom band; wherein said right portion and said left portion are sewn together defining a sheet portion; wherein said top band and said bottom band have a greater width than a width of said sheet portion;

and a pillowcase assembly including a pillowcase, said pillowcase having a top portion made of said first material and a bottom portion made of said second material.

2. The dual material bed linen set of claim 1, wherein said left portion is made of flannel.

3. The dual material bed linen set of claim 1, wherein said right portion is made of cotton.

4. The dual material bed linen set of claim 1, wherein said top portion and said bottom portion are sewn together from a central portion thereof and are configured to receive a pillow therein.

5. The dual material bed linen set of claim 1, wherein said top portion is made of flannel.

6. The dual material bed linen set of claim 1, wherein said bottom portion is made of cotton.

7. The dual material bed linen set of claim 1, wherein said sheet assembly includes a fitting sheet, said fitting sheet having a greater length than a length of said sheet portion.

8. A dual material bed linen set, consisting of:

a sheet assembly, wherein said sheet assembly includes a sheet and a fitting sheet, wherein said sheet is a sheet for bed having a left portion and a right portion, wherein said left portion is made of flannel and said right portion is made of cotton, said sheet including a top band and a bottom band, wherein said left portion and said right portion are sewn together defining a sheet portion, said top band and said bottom band have a greater width than a width of said sheet portion, said fitting sheet having a greater length than a length of said sheet portion, said top band is attached to a top end of said sheet portion, said bottom band is attached to a bottom end of said sheet portion, said sheet has a rectangular shape, said top band and said bottom band have a rectangular elongated shape;

and a pillowcase assembly including a pillowcase, said pillowcase having a top portion made of flannel and a bottom portion made of cotton, wherein said top portion and said bottom portion are sewn together defining said pillowcase, said pillowcase is adapted to receive a pillow therein.

* * * * *